United States Patent [19]

Wolfberg et al.

[11] Patent Number: 4,942,996

[45] Date of Patent: Jul. 24, 1990

[54] FASTENER-DRIVING TOOL

[75] Inventors: Robert L. Wolfberg, Buffalo Grove; Rudolph A. M. Golsch, Arlington Heights; Frank C. Howard, Mount Prospect, all of

[73] Assignee: Illinois Tool Works, Inc., Chicago, Ill.

[21] Appl. No.: 248,185

[22] Filed: Sep. 23, 1988

[51] Int. Cl.[5] ..... B25C 1/04

[52] U.S. Cl. ..... 227/136; 227/128

[58] Field of Search ..... 227/95, 128, 135, 136

[56] References Cited

U.S. PATENT DOCUMENTS 3,708,097 1/1973 Fisher ..... 227/136

3,945,551 3/1976 Sato et al. ..... 227/136

*Primary Examiner*—Frank T. Yost

*Assistant Examiner*—James L. Wolfe

*Attorney, Agent, or Firm*—Thomas W. Buckman; Neal C. Johnson

[57] ABSTRACT

Improvements in a fastener-feeding mechanism for a pneumatically powered, combustion-powered, or other rapidly acting, fastener-driving tool comprising a housing structure, a driver, and a magazine, as well as such a mechanism. The housing structure includes a nosepiece defining a drive track. The drive is mounted for repeatable movement along the drive track. The magazine is adapted to store a strip of collated fasteners, e.g., collated nails, such that a leading portion of the strip extends from the magazine. As a component for feeding fasteners individually and sequentially into the drive track from the leading portion of the strip, a pawl has a groove or grooves adapted to receive one such fastener. A fixed structure confines one of two sides of the leading portion of the strip so as to guide such portion. When in an operative position, a hinged structure confines the other side of such portion so as to guide such portion. The hinged structure includes a holding member adapted when in an operative position to hold one such fastener in the groove or groves and movable to inoperative positions so as to expose the groove or grooves. The hinged structure also includes a hinged cover adapted when in an operative position to secure the holding member in its operative position, as the only way for doing so, and adapted to move so as to allow the holding member to be so moved and so as to expose fastener-guiding surfaces of the fixed structure.

4 Claims, 3 Drawing Sheets

FIG. 7
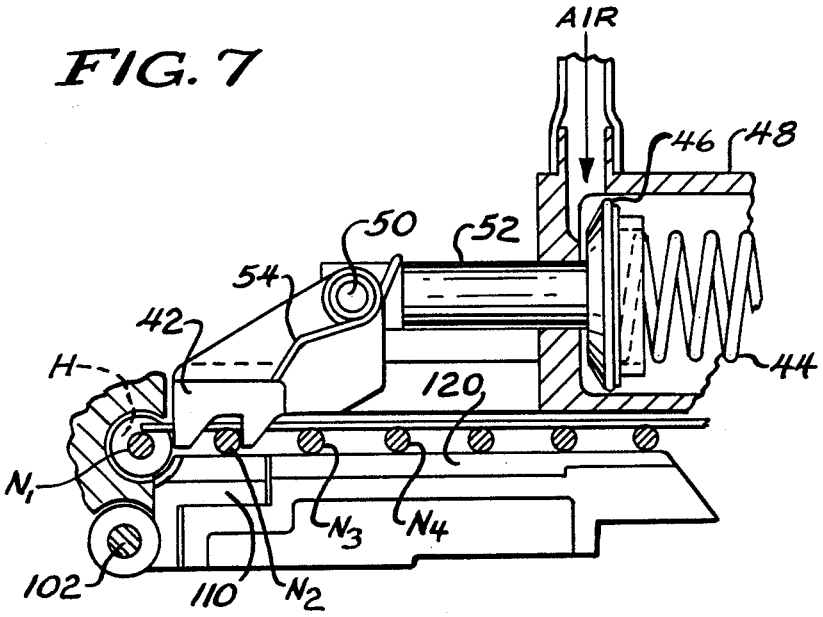
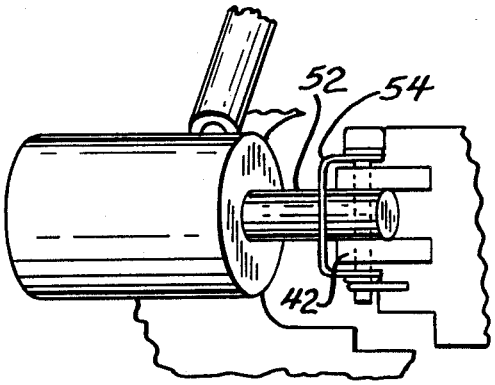
FIG. 8

FASTENER-DRIVING TOOL

BACKGROUND OF THE INVENTION

This invention pertains to a pneumatically powered, combustion-powered, or other rapidly acting, fastener-driving tool of a type utilizing collated fasteners, as exemplified by a portable, pneumatically powered, nail-driving tool employing collated nails.

Typically, a fastener-driving tool of the type noted above comprises a housing structure including a handle and having a nosepiece, which defines a drive track adapted to receive a fastener and to guide the fastener as the fastener is driven from the drive track into a workpiece. Moreover, a piston and cylinder mechanism of the fastener-driving tool includes a driver, which is mounted for reciprocal movement along the drive track so as to be explosively driven by compressed air, by products of combustion, or otherwise from a retracted position to an extended position in a driving stroke, and so as to be oppositely driven by a return spring, by partial vacuum, or by other known means in a return stroke.

Typically, in such a tool, a magazine mounted to the housing structure is adapted to store a strip of collated fasteners, as exemplified by a strip of collated nails with a coiled portion stored in the magazine, so that a leading portion of the strip extends from the magazine toward the drive track. If the fasteners are nails, the nails may be conventionally collated by a pair of wires welded to one side of the nails.

It is known to provide means including a fastener-feeding element, such as a pawl, which has a groove or grooves adapted to receive one such fastener, for feeding fasteners individually and sequentially into the drive track from the leading portion of a given strip of collated fasteners. The fastener received by the groove or grooves of the fastener-feeding element constitutes a second fastener of such portion after a first fastener of such portion has been received by the drive track and before the first fastener has been driven from the drive track.

It is known also to provide a hinged cover, which is hinged to the housing structure, or to the magazine, so as to be hingedly movable between an operative position and inoperative positions, along with means for securing the hinged cover releasably in the operative position. In operative positions, the hinged cover is moved away so as to expose any fasteners between the magazine and the fastener-feeding element, whereby a jammed fastener can be then cleared from the drive track or a new strip of such fasteners can be then loaded.

Mukoyama U.S. Pat. No. 4,600,135 exemplifies such a tool, in which the hinged cover is integral with movable wall portions of the magazine and is hinged to the nosepiece. Fisher U.S. Pat. No. 3,708,097 exemplifies such a tool, in which the hinged cover is separate from the magazine and is hinged to the nosepiece; see, also, Colechia et al. U.S. Pat. No. 3,330,462.

It also is known to provide, in a fastener-driving tool having such a cover hinged to the magazine on an axis spaced from the nosepiece, a hinged latch, which is hinged to the nosepiece, and which is bolted into an operative position wherein the hinged latch is adapted to latch the hinged cover in an operative position. When unbolted, the hinged latch can be hingedly moved away so as to expose the drive track and fastener-feeding pawl of the fastener-driving tool, which cannot be then operated until the hinged latch has been rebolted.

A troublesome problem with many such tools, as known heretofore, is that the nail or other fastener received by the groove or grooves of the fastener-feeding element of such a tool tends to be easily dislodged from such groove or grooves as the hinged cover is moved to its operative position, e.g., after a jammed fastener has been cleared or after a new strip has been loaded. Consequently, the dislodged fastener can become another jammed fastener, which needs to be then cleared, or the hinged cover cannot be then moved to its operative position.

SUMMARY OF THE INVENTION

This invention, which addresses the aforenoted problem, provides improvements in a pneumatically powered, combustion-powered, or other rapidly acting, fastener-driving tool, particularly but not exclusively a nail-driving tool.

Broadly, the fastener-driving tool comprises a housing structure having a nosepiece defining a drive track and a magazine mounted to the housing structure and adapted to store a strip of collated fasteners, as exemplified by a strip of collated nails with a coiled portion stored in the magazine, so that a leading portion of the strip extends from the magazine toward the drive track. The drive track is adapted to receive a fastener and to guide the fastener as the fastener is driven from the drive track.

Moreover, the fastener-driving tool comprises a nail-feeding mechanism, which is mounted operatively to the housing structure. The nail-feeding mechanism has novel features addressing the aforenoted problem.

Specifically, the nail-feeding mechanism includes means for feeding fasteners individually and sequentially into the drive track from the leading portion of a given strip of collated fasteners thus stored by the magazine. Such means includes a fastener-feeding element, as exemplified by a pawl, which has at least one groove adapted to receive one such fastener. The fastener received by the groove or grooves of the fastener-feeding element constitutes a second fastener of the same portion after a first fastener of the same portion has been received by the drive track and before the first fastener has been driven from the drive track.

Moreover, the nail-feeding mechanism includes a fixed structure and a hinged structure, which cooperate so as to guide the leading portion of such a strip as fasteners from the same portion are thus fed. The fixed structure is fixed to the housing structure, preferably between the nosepiece and the magazine, and is adapted to confine one of two sides of the leading portion thereof so as to guide such portion along fastener-guiding surfaces of the fixed structure as fasteners from the same portion are thus fed. The hinged structure is hinged to the nosepiece. When disposed in an operative position, the hinged structure confines the other side of the same portion so as to guide the same portion along fastener-guiding surfaces of the hinged structure as fasteners from the same portion are thus fed. The hinged structure is adapted to be hingedly moved to inoperative positions so as to expose fastener-guiding surfaces of the fixed structure and any fasteners between the magazine and the fastener-feeding element whereby a fastener jammed in the drive track can be then cleared or a new strip of collated fasteners can be then loaded into the nail-feeding mechanism.

According to this invention, the hinged structure includes a holding member and a hinged cover, each being hinged to the nosepiece, preferably on a common axis. The holding member, which is a novel component of a fastener-driving tool, is adapted when disposed in an operative position to hold one such fastener in the groove or grooves of the fastener-feeding element and adapted to be hingedly moved to inoperative positions so as to expose such groove or grooves, any such fastener in such groove or grooves, and any such fastener in the drive track. The hinged cover, which has novel aspects, is adapted when disposed in an operative position to hold the holding member in its operative position, as the sole means for doing so, and adapted to be hingedly moved to inoperative positions so as to allow the holding member to be hingedly moved to inoperative positions, and so as to expose fastener-guiding surfaces of the fixed structure and any fasteners between the magazine and the fastener-feeding element. Means are provided for securing the hinged cover releasably in its operative position with the holding member in its operative position.

The holding member tends to prevent such a fastener from becoming dislodged from the groove or grooves of the fastener-feeding element as the hinged cover is moved to its operative position, e.g , after a jammed fastener has been cleared or after a new strip has been loaded.

As an optional feature, the hinged cover may be advantageously fixed to movable wall portions of the magazine, which then has fixed wall portions fixed to the housing structure. The securing means may be then adapted to secure the fixed and movable wall portions of the magazine to each other.

Preferably, the magazine is adapted to store a strip of collated nails, or other collated fasteners, such that a coiled portion of the strip is stored in the magazine and such that a leading portion of the strip is uncoiled so as to extend from the magazine toward the drive track.

These and other objects, features, and advantages of this invention are evident from the following description of a preferred embodiment of this invention with reference to the accompanying drawings.

Herein, directional terms, such as "upper", "lower", "transverse", and "vertical" are used for convenient reference to the preferred embodiment, as shown in one convenient orientation in the accompanying drawings, and are not intended to limit this invention to any particular orientation.

BRIEF DESCRIPTION OF THE DRAWINGS

FIG. 7 is a fragmentary, partly sectional view, which is similar to FIGS. 4 and 6 except that the hinged cover and the holding member have been returned to their respective positions in FIG. 1, and except that more details of a fastener-feeding mechanism have been added in FIG. 7.

FIG. 8 is a fragmentary, perspective view of some details of the fastener-feeding mechanism, as viewed from behind the nail-driving tool as shown in FIG. 1.

DETAILED DESCRIPTION OF THE PREFERRED EMBODIMENT

Figure 1:
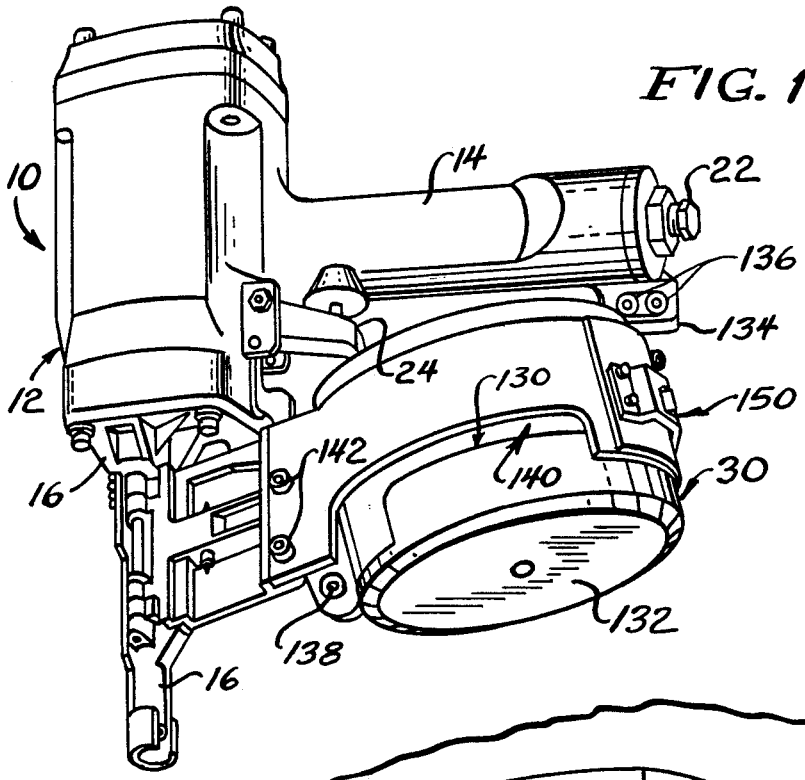
FIG. 1 is a perspective view of a portable, pneumatically powered, nail-driving tool, which constitutes a preferred embodiment of this invention.

As shown in one convenient orientation in the drawings, a portable, pneumatically powered, nail-driving tool 10 constitutes a preferred embodiment of this invention.

Broadly, the nail-driving tool 10 comprises a housing structure 12 including a handle 14 and having a nosepiece 16, which is bolted to the housing structure 12, and which defines a drive track 18 adapted to receive a nail and to guide the nail as the nail is driven from the drive track 18 into a workpiece (not shown) of wood or other material. Moreover, the nail-driving tool 10 comprises a piston and cylinder mechanism including a driver 20, which is shown in a retracted position (in phantom lines) in FIG. 2. Other elements of the piston and cylinder mechanism are conventional and are not shown in the drawings. The driver 20, which has a longitudinal axis, is mounted for reciprocal movement along the drive track 18 so as to be explosively driven by compressed air, as supplied to the nail-driving tool 10 through a conventional fitting 22, which is shown incompletely in FIG. 1, from the retracted position to an extended position in a driving stroke, and so as to be oppositely driven in a conventional manner by means (not shown) from the extended position to the retracted position in a return stroke.

As shown, the nail-driving tool 10 comprises a trigger 24, which is adapted to be finger-actuated, and a work-contacting element 26, which is adapted to be upwardly displaced when pressed against a workpiece (not shown) so as to actuate the nail-driving tool 10 if the trigger 24 has been actuated. When the trigger 24 has been actuated and the work-contacting element 26 has been displaced upwardly, compressed air, as admitted to the nail-driving tool 10 through the fitting 22, imparts explosive, downward movement to the piston of the piston and cylinder mechanism discussed above, and thus to the driver 20, to which a driving stroke thus is imparted.

Likewise, the nail-driving tool 10 comprises a magazine 30, which is mounted to the housing structure 12 in spaced relation to the drive track 18. The magazine 30, which has fixed wall portions described below and movable wall portions described below, is adapted to store a strip of collated nails N so that a coiled portion (not shown) of the strip is stored in the magazine 30 and so that a leading portion of the strip of collated nails N extends from the magazine 30 toward the drive track 18. The magazine 30 may have a central post (not shown) about which the coiled portion of the strip is disposed. The nails N are collated, in a known manner, by a pair of wires 32, 34, which are welded to the nails N along one side of each nail. The wires 32, 34, are fractured between a nail in the drive track 18 and the next nail as the nail in the drive track 18 is driven. The leading portion of the strip, as shown, is straightened by components described below, between the magazine 30 and the drive track 18.

Furthermore, the nail-driving tool 10 comprises a nail-feeding mechanism 40, which is mounted operatively to the housing structure 12 and which includes means for feeding the nails N individually and sequentially from the coiled strip of collated nails N stored by the magazine 30. The feeding means includes a nail-feeding pawl 42, which is mounted for movement between an extended position, as shown, and a retracted position. The nail-feeding pawl 42 is biased to its extended position by a compression spring 44 and is adapted to be pneumatically driven to its retracted position by compressed air when a driving stroke is imparted to the driver 20. A small amount of compressed air, as admitted to the nail-driving tool 10 through the connector 22, is diverted so as to bear against a given face of small piston 46, which is movable within a small cylinder 48, and which is movable conjointly with the nail-feeding pawl 42. The compression spring 44 bears against the opposite face of the small piston 46. The nail-feeding pawl 42 is mounted pivotally by a pin 50 to a rod 52 extending axially from the small piston 46 and is biased in one pivotal sense, which is counter-clockwise as shown in FIG. 7, by a torsion spring 54. The nail-feeding pawl 42 is provided, where it faces the nail N, with an upper groove 56 and a lower groove 58. The grooves 56, 58, are aligned vertically and are adapted to receive one nail, which constitutes a second nail $N_2$ of the leading portion of the strip of collated nails N after a first nail $N_1$ of such portion has been received by the drive track 18 and before the first nail $N_1$ has been driven from the drive track. Such portion thus includes a third nail $N_3$, a fourth nail $N_4$, and so on. The nail-feeding pawl 42 also is provided with upper camming surfaces 60, 62, which face backwardly on opposite sides of the upper groove 56, a middle camming surface 64, which faces backwardly, and lower camming surfaces 66, 68, which face backwardly on opposite sides of the lower grooves 58. The nail-feeding pawl 42 also is provided, where it faces the nails, with transverse grooves 70, 72, which accommodate the respective wires 30, 32.

As shown, the nails N have full heads H, which are conventional. One such head H is shown (in phantom lines) in an upper portion of the drive track 18 in FIGS. 3, 4, 6, and 7. Alternatively, the nails N can have differently shaped shanks and differently shaped heads, e.g., D-shaped, so-called clipped heads.

The camming surfaces described above allow the nail-feeding pawl 42 to be backwardly drawn over the second and third nails of the strip (not counting the first nail in the drive track) from the extended position of the nail-feeding pawl 42 to its retracted position when compressed air is applied to the small piston 46, so that the nail-feeding pawl 42 receives a new nail (which had been the third nail of the nail strip) in the grooves 56, 58. A unidirectional latch 80, which is described below, engages the following nail, i.e., the nail following the new nail received in the grooves 56, 58, to prevent the nail strip from being drawn backwardly with the nail-feeding pawl 42. The unidirectional latch 80, however, allows the strip of collated nails N to be forwardly fed. When compressed air no longer is applied to the small piston 46, the compression spring 44 returns the nail-feeding pawl 42 to its extended position, whereby the nail-feeding pawl 42 feeds a new nail (which had been the second nail of the nail strip) forwardly into the drive track 18.

Except for certain features described below, the strip of collated nails N and the various components of the nail-driving tool 20, as discussed in the preceding paragraphs, are conventional in portable, pneumatically powered, nail-driving tools, as manufactured heretofore by or for and sold heretofore by Paslode Corporation of Lincolnshire, Ill. Further details of the strip of collated nails N and further details of such conventional components have been omitted as unnecessary for a full comprehension of this invention.

Moreover, the nail feeding mechanism 40 includes a fixed structure and a hinged structure, which cooperate so as to guide the leading portion of the strip of collated nails N, and so as to straighten such portion as nails N from such strip are fed in a manner described above. The fixed structure 90 is fixed to the housing structure 12, so as to extend between the nosepiece 16 and the magazine 30, and is adapted to confine a given side of the leading portion of the strip of collated nails N, i.e., the side having the collating wires 32, 34, which are accommodated by transverse grooves 92, 94, in nail-guiding surfaces 96 of the fixed structure 90, so as to guide the leading portion of such strip along such surfaces 96 as nails N from such portion are fed. The hinged structure 100 is hinged to the nosepiece 16 so as to be hingedly movable about a pin 102 having a vertical axis between an operative position, as illustrated in FIGS. 1 and 7, and inoperative positions, as exemplified in FIGS. 2 through 6. When disposed in its operative position, the hinged structure 100 confines the other side of the leading portion of such strip 20 as to guide such portion along nail-guiding surfaces of the hinged structure 100 as nails N from such portion are fed in the manner described above. The hinged structure 100 is adapted to be hingedly moved to inoperative positions, as discussed above, so as to expose nail-guiding surfaces 96 of the fixed structure 90 and any nails between the magazine 30 and the nail feeding pawl 42. Thus, any nail jammed in the drive track 18 can be then cleared. Also, a new strip of collated nails can be then loaded into the nail-feeding mechanism.

Ordinarily, when a new strip of collated nails is loaded into the nail-feeding mechanism, a first nail of the new strip is manipulated into the nail-receiving grooves 58, 60, of the nail-feeding pawl 42, not directly into the drive track 18. If so, the nail-driving tool 10 must be twice actuated so as to drive the first nail of the new strip, since the first nail of the new strip is fed into the drive track after the nail-driving tool 10 has been once actuated. The aforenoted problems with many such tools, as known heretofore, arise because the first nail of such a strip tends to be easily dislodged from such grooves.

Figure 2:
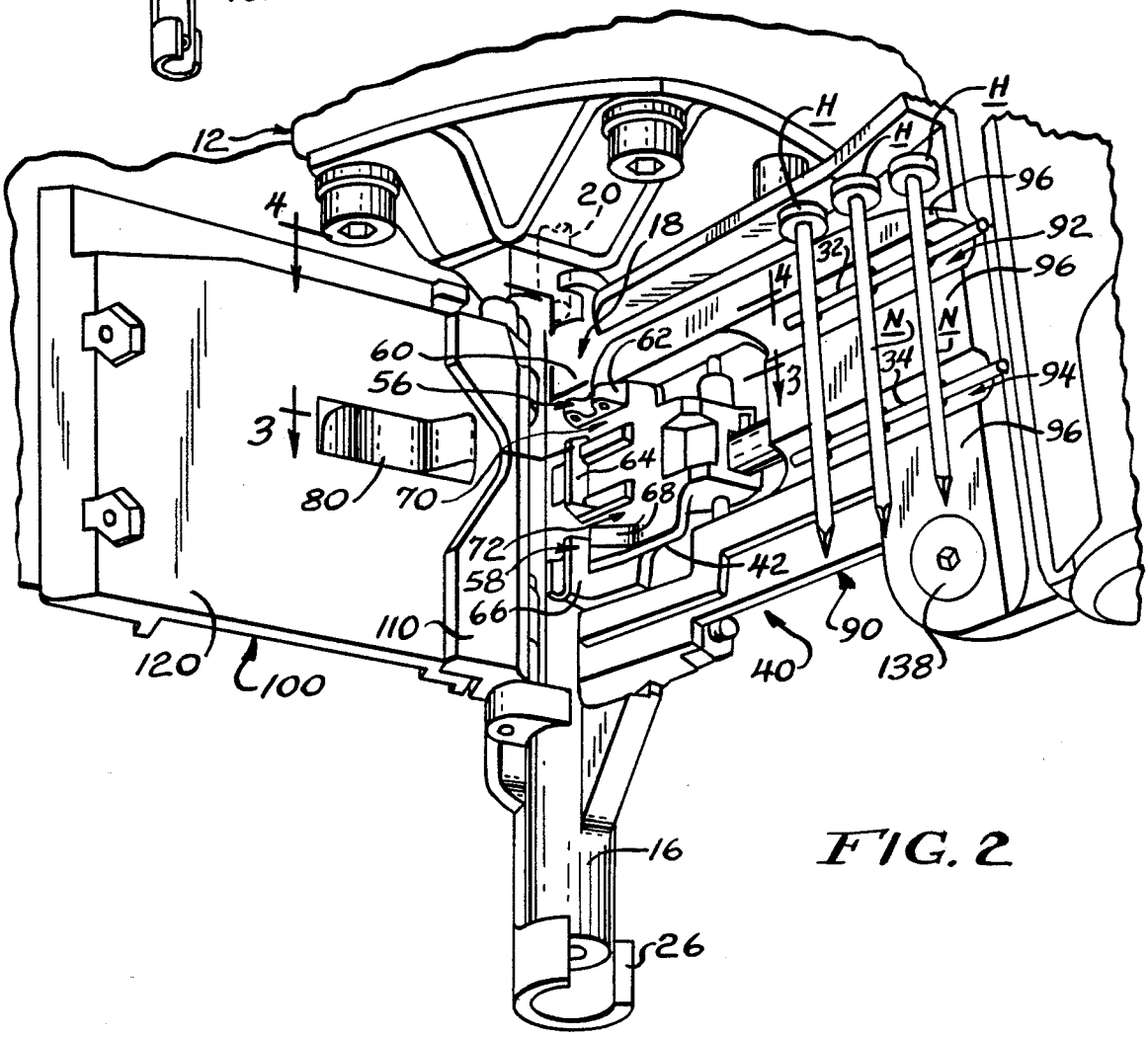
FIG. 2 is an enlarged, fragmentary, perspective view of a nosepiece and associated elements of the nail-driving tool, as shown in FIG. 1 except that a hinged cover and a holding member have been moved from their respective positions in FIG. 1. Some nails from a leading portion of a strip of collated nails are shown in FIG. 2.
Figure 3:
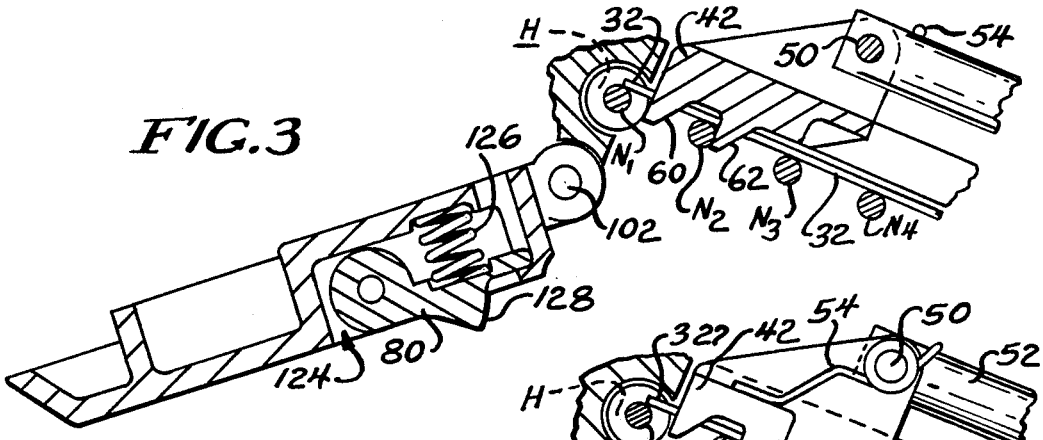
FIGS. 3 and 4 are fragmentary, partly sectional views, as taken respectively along lines 3—3 and 4—4 in FIG. 2 in directions indicated by arrows. Some nails of the leading portion of the strip of collated nails not shown in FIG. 2 (for reasons of simplification) are shown also in FIGS. 3 and 4.
Figure 4:
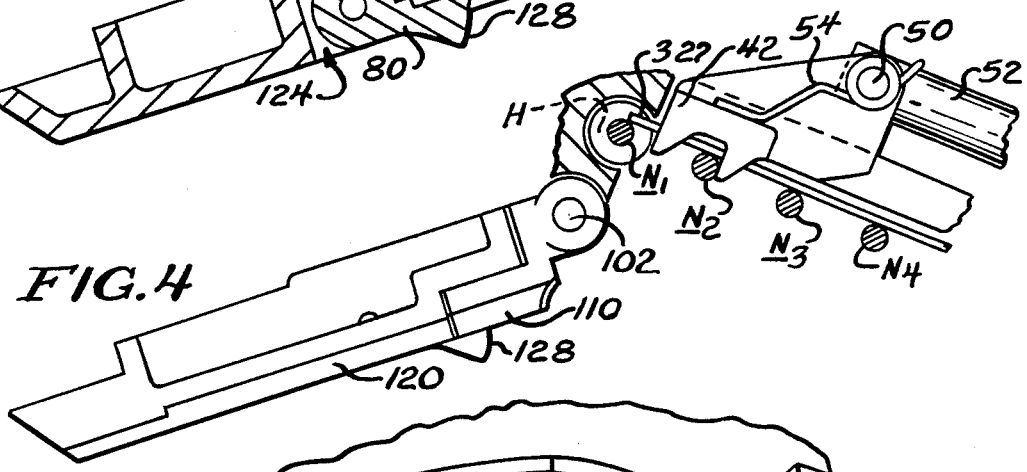
Figure 5:
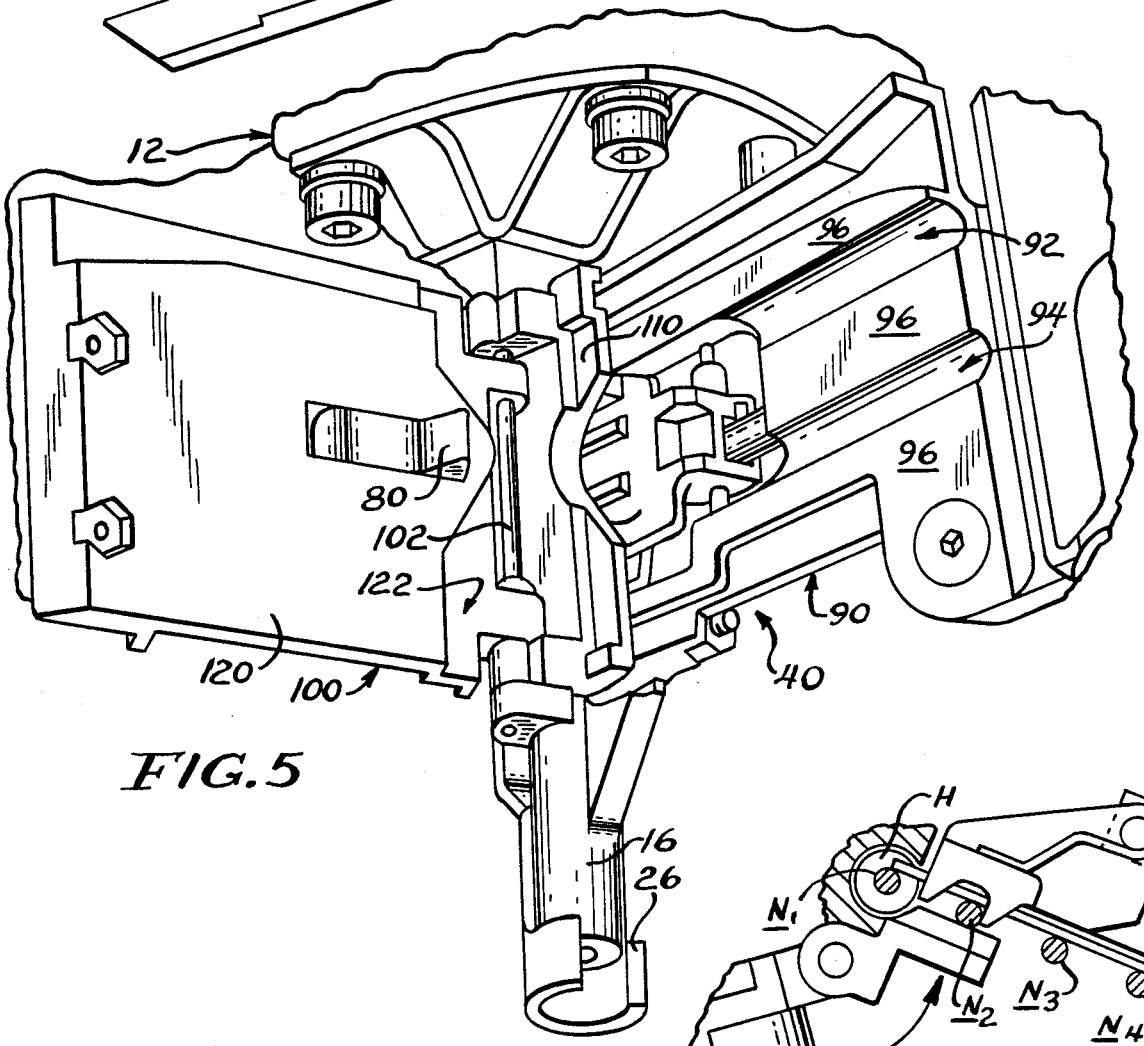
FIG. 5 is a similarly enlarged, fragmentary, perspective view, which is similar to FIG. 2 except that the holding member has been moved from its position in FIG. 2.
Figure 6:
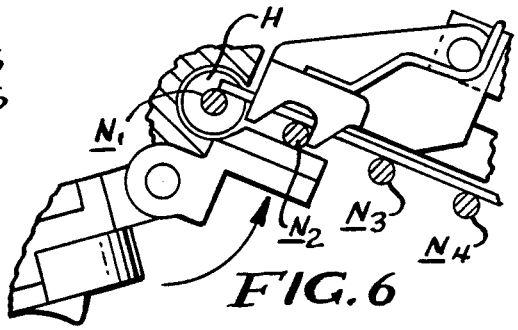
FIG. 6 is a fragmentary, partially sectional view, which is similar to FIG. 4 except that the holding member has been moved, as in FIG. 5, and except that some details shown in FIG. 4 have been omitted in FIG. 6. Some nails of the leading portion of the strip of collated nails are shown also in FIG. 6.

According to this invention, however, the hinged structure 100 includes a holding member and a hinged cover, each being hinged to the nosepiece 16 so as to be hingedly movable about the pin 102. The holding member 110, which is a novel component of the nail-driving tool 10, is adapted to be hingedly movable between an operative positon, as suggested in FIG. 1 and illustrated in FIGS. 5, 6, and 7, and inoperative positions, as exemplified in FIGS. 2, 3, and 4. When disposed in its operative position, the holding member 110 is adapted to cover the nail-receiving grooves 56, 58 of the nail-feeding pawl 42 so as to hold one of the nails N in such grooves 56, 58. The holding member 110 is adapted to be hingedly moved to inoperative positions so as to expose such grooves 56, 58 and any nail in such grooves 56, 58. The holding member 110 may be easily flipped into and out from its operative position so long as the hinged cover to be next described has been moved from its operative position. The hinged cover 120, which has novel aspects, is provided with a recess 122 accommodating the holding member 110, as shown in FIG. 2. The hinged cover 120 is adapted to be hingedly movable between an operative position, as illustrated in FIGS. 1 and 7 and inoperative positions, as exemplified in FIGS. 2 through 6. When disposed in its operative position, the hinged cover 120 is adapted to hold the holding member 110 in its operative position, as discussed above, in which the holding member 110 is adapted to hold one of the nails N in the nail-receiving grooves 56, 58 of the nail-feeding pawl 42. The hinged cover 120 is adapted to be hingedly moved to inoperative positions so as to allow the holding member 110 to be hingedly moved to inoperative positions, as discussed above, and so to expose nail-guiding surfaces 96 of the fixed structure 90, any nails between the magazine 30 and the fastener-feeding pawl 42, and any nail in the drive track 18.

As shown, the unidirectional latch 80 is mounted pivotally in a recess 124 in the hinged cover 120 for pivotal movement between an operative position, as illustrated, and inoperative positions and is biased by a compression spring 126 to its operative position. The unidirectional latch 80 has a camming portion 128, which is adapted to fit between the nail in the nail-receiving grooves 56, 58, of the nail-feeding pawl 42, e.g., the nail $N_2$ in the drawings, and the following nail, e.g., the nail $N_3$ in the drawings, when the hinged cover 120 is disposed in its operative position, and which is adapted when fitted therebetween to permit the strip of collated nails N to be forwardly fed, but to prevent the strip of collated nails N from being drawn backwardly with the nail-feeding pawl 42. Such a latch has been known heretofore in nail-driving tools.

As mentioned above, the magazine 30 has fixed wall portions and movable wall portions. Fixed wall portions 130, which include a floor portion 132 beneath the coiled portion of the strip of collated nails N, are mounted fixedly to the handle 14 by a brack 134 and bolts 136 and are mounted fixedly to the fixed structure 90 by a bolt 138. Movable wall portions 140 are mounted fixedly to the hinged cover 120 by bolts 142 so as to be conjointly movable with the hinged cover 120. A manually operable latch 150 is provided, which is adapted to secure the fixed and movable wall portions releasably to each other, thereby to secure the hinged cover 120 releasably in its operative position with the holding member 110 in its operative position.

What is claimed is:

1. A fastener-driving tool comprising:

(a) a housing structure having a nosepiece defining a drive track adapted to receive a fastener and to guide the fastener as the fastener is driven from the driver track;

(b) a magazine mounted to the housing structure in spaced relation to the drive track and adapted to store a strip of collated fasteners so that a leading portion of the strip extends from the magazine toward the drive track; and (c) a nail-feeding mechanism mounted operatively to the housing structure, the nail-feeding mechanism including:

(1) means for feeding fasteners individually and sequentially into the drive track from the leading portion of a given strip of collated fasteners thus stored by the magazine, said means including a fastener-feeding element having at least one groove adapted to receive one such fastener;

(2) a fixed structure fixed to the housing structure and adapted to confine one of two sides of the leading portion of the given strip so as to guide the leading portion of the given strip along fastener-guiding surfaces of the fixed structure as fasteners from the leading portion of the given strip are thus fed;

(3) a hinged structure hinged to the nosepiece and adapted when disposed in an operative position to confine the other side of the leading portion of the given strip so as to guide the leading portion of the given strip along fastener-guiding surfaces of the hinged structure as fasteners from the leading portion of the given strip are thus fed, the hinged structure including:

(i) a holding member hinged to the nosepiece, adapted when disposed in an operative position to hold one such fastener in the groove of the fastener-feeding element, and adapted to be hingedly moved to inoperative positions so as to expose said groove, any such fastener in said groove, and any such fastener in the drive track; and (ii) a hinged cover hinged to the nosepiece, adapted when disposed in an operative position to secure the holding member in the operative position of the holding member, as the sole means for securing the holding member in the operative position of the holding member, and adapted to be hingedly moved to inoperative positions so as to allow the holding member to be hingedly moved to inoperative positions of the holding member, and so as to expose fastener-guiding surfaces of the fixed structure, any fasteners between the magazine and the fastener-feeding element, and any fastener in the drive track; and (4) means for securing the hinged cover releasably in the operative position of the hinged cover with the holding member in the operative position of the holding member.

2. The fastener-driving tool of claim 1 wherein the magazine includes fixed wall portions, which are fixed to the housing structure, and movable wall portions, which are fixed to the hinged cover so as to be conjointly movable with the hinged cover.

3. The fastener-driving tool of claim 2 wherein the means for securing the hinged cover in the operative position of the hinged cover is adapted to secure the fixed and movable wall portions of the magazine to each other.

4. The fastener-driving tool of claim 2 wherein the magazine is adapted to store a strip of collated fasteners such that a coiled portion of the strip is stored in the magazine and such that a leading portion of the strip extends from the magazine toward the drive track.

* * * * *